United States Patent [19]

Kurtz

[11] 4,019,637

[45] Apr. 26, 1977

[54] CATHODE RAY TUBE PACKAGING

[75] Inventor: Joseph M. Kurtz, Ottawa, Ohio

[73] Assignee: GTE Sylvania Incorporated, Stamford, Conn.

[22] Filed: July 16, 1976

[21] Appl. No.: 705,775

[52] U.S. Cl. ..... 206/418; 206/521; 229/39 B

[51] Int. Cl.[2] ..... B65D 85/42

[58] Field of Search ..... 206/418–422, 206/491, 521, 525, 45.19; 229/14 C, 39 B

[56] References Cited

UNITED STATES PATENTS

| | | | |
|---|---|---|---|
| 2,377,604 | 6/1945 | Belden | 206/418 |
| 2,877,942 | 3/1959 | Van Antwerpen | 206/521 X |
| 3,227,357 | 1/1966 | Knapp et al. | 229/39 B |
| 3,294,226 | 12/1966 | McFarland et al. | 206/418 |
| 3,400,879 | 9/1968 | O'Brien et al. | 229/39 B |

*Primary Examiner*—Steven E. Lipman
*Attorney, Agent, or Firm*—Norman J. O'Malley; Frederick H. Rinn; Robert T. Orner

[57] ABSTRACT

An improved single cavity packaging enclosure is provided for supporting and protecting an individual cathode ray tube. The enclosure is fabricated from a unitary sheet of foldable substantially rigid material and contains integral supportive structures, wherein discrete lip configurations effect beneficial positional retention of formed tube-supporting therein.

8 Claims, 5 Drawing Figures

CATHODE RAY TUBE PACKAGING

BACKGROUND OF THE INVENTION

This invention relates to packaging means for cathode ray tubes and more particularly to improved packaging means for an individual cathode ray tube. In general, cathode ray tubes by nature of their conventional glass construction are inherently fragile structures. Therefore, in storing and transporting individual tubes, careful consideration must be directed to achieving appropriately sturdy packaging means. The transportation of single tubes is usually effected through conventional express and freight channels, and as such, the units are subject to the environmental rigors experienced in those mediums of transit and at the transfer terminals enroute. Therefore, sturdy packaging means is essential to afford the necessary protection for the tube in transit. It has been a common practice to utilize a carton comprising a combination of substantially corrugated paperboard components, such being individually cut, formed, and interlocked to produce an integrated container means for accommodating a single tube. Such multiple component construction requires a number of expensive die-cut pieces to provide the container shell along with the necessary internal structural supportive means to achieve suitable packaging having the requisite strength to accommodate the tube and protect the same against possible damage. Use of the multiple-piece container requires storage, handling, and matching of the componental parts to achieve the ultimately integrated structure. In addition, a time consideration is evidenced in assemblying the multiple-part units, and a shortage of any one of the components halts the construction of the containers.

OBJECTS AND SUMMARY OF THE INVENTION

It is an object of the invention to reduce and obviate the aforementioned disadvantages evidenced in the prior art. Another object of the invention is to provide an improved single cavity packaging enclosure for supporting and protecting a cathode ray tube exhibiting improved structural rigidity and protective features. Another object of the invention is to provide a one-piece single cavity cathode ray tube enclosure wherein the discretely folded portions effect beneficial support and ruggedness to the container.

The foregoing and other objects and advantages are achieved in one aspect of the invention by the provision of an improved one-piece single cavity packaging means for accommodating an individual cathode ray tube. The improved packaging construction is fabricated from a unitary sheet of substantially rigid material which is folded along a multiplicity of score-lines to provide a one-compartment container wherein the tube is securely and protectively positioned. Discrete portions of the structure are folded interiorly to provide two opposed wall-oriented internal supportive constructions which are locted parallel with respective wall members of the enclosure. The terminal portion of each of these interior constructions is folded in a manner to provide a shelf-like supportive means upon which the funnel portion of the tube is rested. The fold line of this shelf-like means has at least one shallow, longitudinal cut-defined lip hinged therealong and cut slightly into the edge of the respective contiguous terminal portion to effect locked positional retention of the folded shelf-like support. One of the closures for the container is effected by a juxtapositional relationship of two mating tongued portions which are inserted into slot means formed in the aforementioned wall-oriented constructions to provide a secure alpha closure arrangement. The opposed omega closure arrangement is effected by the overlapping of four flap-like members integral with the wall members.

DESCRIPTION OF THE PREFERRED EMBODIMENT

Figure 1:
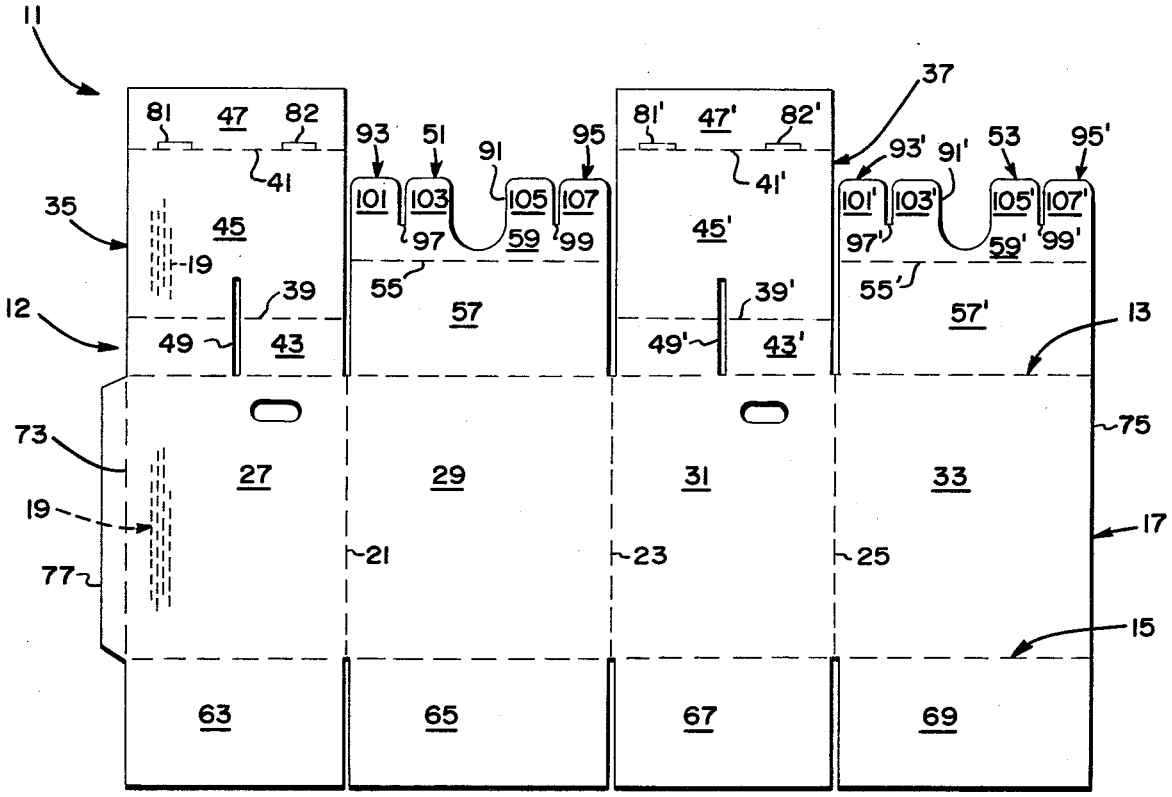
FIG. 1 is a plan view of a unitary sheet of material wherein the related portions of the enclosure structure are delineated by configurations and pre-defined fold-score-lines.

For a better understanding of the present invention, together with other and further objects, advantages and capabilities thereof, reference is made to the following specification and appended claims in connection with the aforedescribed drawings.

In describing the invention, there is shown in the Figures a single cavity packaging enclosure 11 for accommodating an individual cathode ray tube which evidences marked improvements over enclosures known in the art. The integrated packaging structure as shown is formed from a unitary sheet 12 of foldable substantially rigid material such as, for example, plastic corrugated board or corrugated paperboard. While these materials may be inflammable, they can be readily formulated by known means to exhibit flame retardative properties. The fabricated sheet, as initially configurated, is of substantially elongated shaping having spaced apart alpha 13 and omega 15 fold score-lines which extend longitudinally therein and define therebetween the central portion 17 of the sheet. The material comprising the sheet is oriented in a manner that the strengthening flutes 19 of the corrugated construction are oriented normal to the alpha 13 and omega 15 score-lines. In conjunction therewith, three parallel and spatially related fold-scorelines 21, 23 and 25 traverse the central portion 17 in a manner normal to the alpha and omega score lines to divide the central portion into first 27, second 29, third 31, and fourth 33 integral wall members, the aforenoted score-lines subsequently providing corner formations for the respective walls.

Extending outward from the alpha score-line 13 related to the first 27 and third 31 wall members, are similar integral substantially rectangular extension members 35 and 37. Each of these members has spaced apart and parallelly related proximal 39, 39' and distal 41, 41' traversal score-lines which divide the respective extension members 35 and 37 into base 43, 43', side 45, 45' and terminal 47, 47' portions. Each of these rectangular extensions has a slot 49, 49' formed therein normal to the alpha score-line 13 in a manner to substantially bisect the respective base portion 43, 43' and extend thereacross partially into the respective related side portion 45, 45'.

Extending outward from the alpha score-line 13 related to the second 29 and fourth 33 wall members, are similar integral configurated alpha closure members 51 and 53. Each of these discretely-shaped members has a structural score line 55, 55' thereacross dividing the member into a respective rectangular planar portion 57, 57' and a respective terminal plural tongue projecting portion 59, 59'. These configurated closure members 51 and 53 cooperatively provide a subsequent alpha closure arrangement 61 for the packaging means 11.

Extending outward from the omega score line 15 are separate and substantially rectangular flat-like members 623, 65, 67 and 69 which are formed integral with the respective wall members 27, 29, 31 and 33 to subsequently collectively provide an over-lapping omega enclosure arrangement for the tube packaging means 11.

Figure 5:
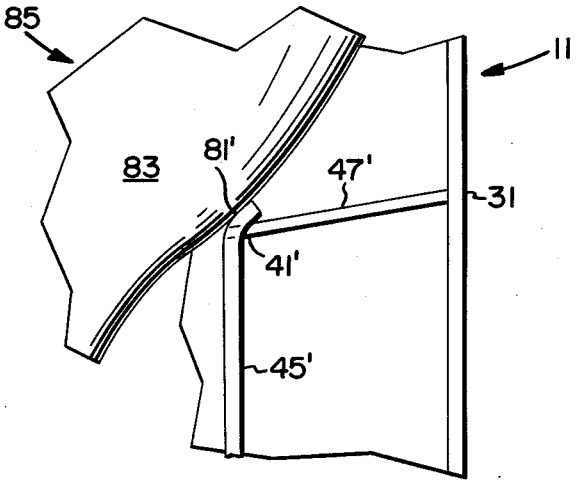
FIG. 5 is a partially sectioned enlargement illustrating the lip construction associated with the edge-fold of the shelf-like internal support.

The aforedescribed configurated sheet 12 of corrugated material is folded along the aforementioned wall score lines 21, 23 and 25 to shape the first 27, second 29, third 31, and fourth 33 wall members; whereupon the boundary edges 73 and 75 of the first 27 and fourth 33 wall members are joined, through the utilization of an edge flap 77, by bonding means such as stitching, stapling or gluing. The separate foldable extension members 35 and 37, integral and projecting from the alpha 13 terminal edges of the first 27 and third 31 wall members, are folded inwardly along the related proximal 39, 39' and distal 41, 41' score-lines thereby forming base 43, 43', side 45,45' and terminal 47, 47' portions to provide two opposed wall-oriented structures 79 and 79', such being interiorly parallel with the first 27 and third 31 wall members. The terminal portions 47, 47' of each of these internal structures 79, 79', being folded along the distal score lines toward the respective side members, provides two shelf-like means for supporting the funnel portion 83 of the tube 85. Associated with the distal score-line 41, 41' of each supportive structure 79, 79' is at least one shallow longitudinal cut-defined lip configuration 81, 81' cut into the edge of the shelf support 47, 47' and hinged along the respective distal score-line 41, 41' to effect locked retention of the score-line fold forming the shelf-like support 47, 47'. It is to be noted that the strengthening flutes 19 of the corrugated material, being normal to the distal 41, 41' and proximal 39, 39' score lines, provide optimized strengthening to the structure. As exemplarily shown, there are two spaced apart cut-out lip configurations 81, 81', 82, 82' which are spaced on the respective score-line flutes 41, 41' in a manner that the weight of the tube 85 in conjunction with the orientation of the strengthening flutes 19 of the material, effects a slight deformation of each lip to further accentuate the locked retention of the respective fold forming the shelf-like support 47, 47'; such being further illustrated in FIG. 5. This lip-formed shelf-retention feature is considered an important structural feature of the invention. It is to be noted that the so-formed funnel support shelf is spaced from the omega closure means 71 to allow sufficient space for accommodating the forward funnel and panel portion 87 of the tube.

The two alpha closure members 51 and 53, associated with the second and fourth wall members, are each folded along its respective structural score line 55 and 55', whereof the tongue portions 59 and 59' are folded inwardly and substantially normal to the planar portions 57 and 57' in a manner that the two tongue portions meet in juxtapositional relationship; whereupon they are inserted into the slot means 49, 49' formed in the base portions 43 and 43' of the wall-oriented support structures 79, 79' to provide the alpha closure arrangement 61. It is to be noted that the two juxtapositionally related tongue portions each have a common centrally-oriented cut-out segment 91, 91' dimensioned to spatially accommodate the neck portion 89 of the tube positioned adjacently therein. Each of these cut-out segments substantially divides the respective projecting portions 59 and 59' into two parts 93 and 95. In turn, each of these parts has a cleft 97, 97' and 99, 99' formed therein in a manner to extend from the forward edge thereof for a partial distance toward the structural score-line 55, 55', thereby partially dividing each of the parts 93, 93' and 95, 95' into two tongue-like segments 101, 103, 105, 107; 101', 103', 105', 107'. Such segments are fitted into slots 49 and 49' with the respective slots and clefts inter-locking in a manner to consummate the alpha closure as described.

Figure 2:
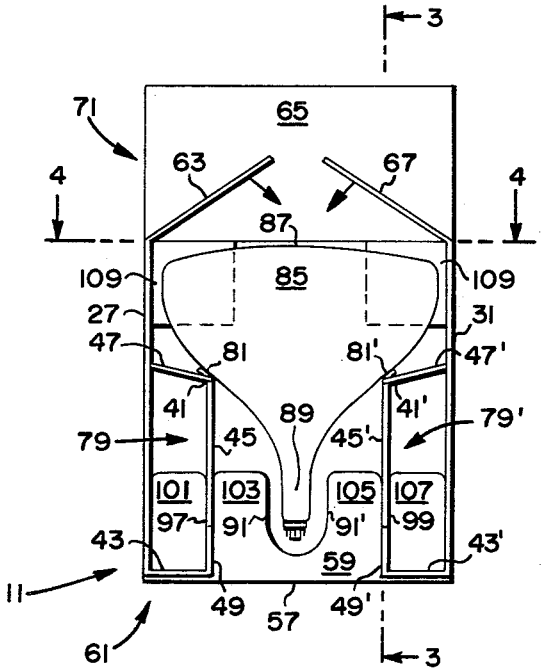
FIG. 2 is an elevational cross-section illustrating the assembled packaging enclosure structure of the invention.
Figure 3:
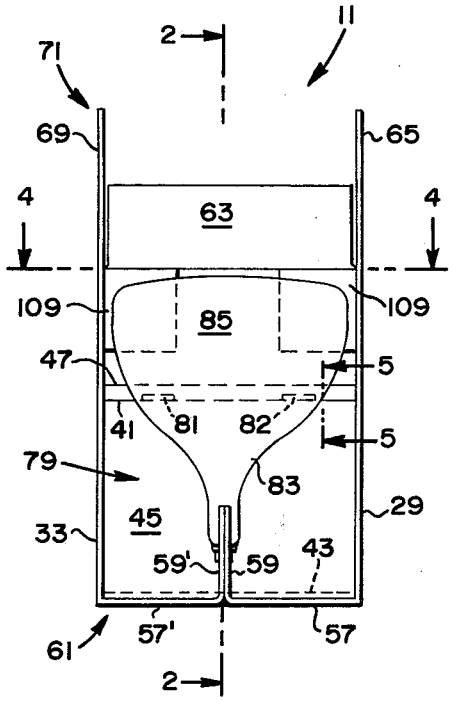
FIG. 3 is another elevational cross-section of the assembled packaging enclosure taken along the line 3—3 of FIG. 2.
Figure 4:
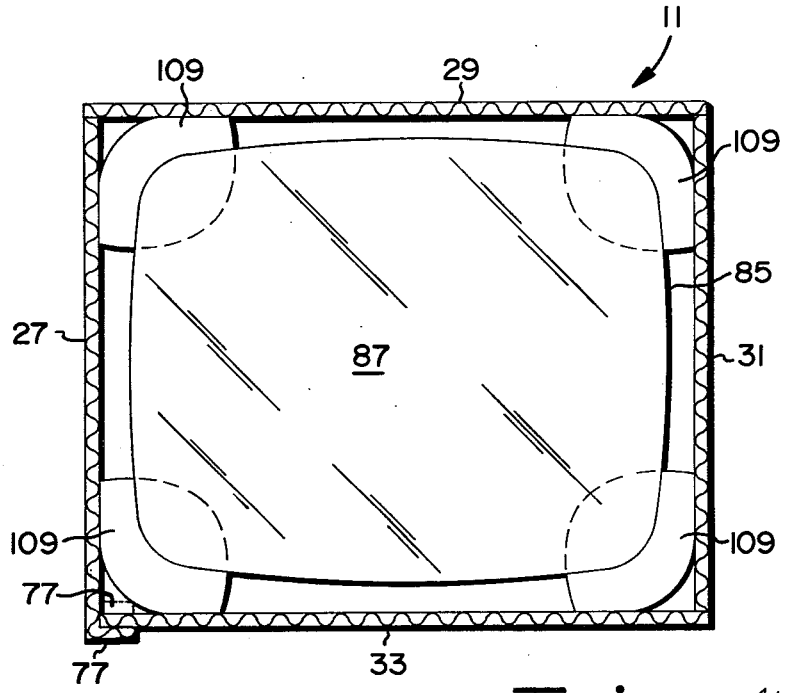
FIG. 4 is a plan view of the assembled enclosure taken along the lines 4—4 of FIGS. 2 and 3.

As shown in FIGS. 2, 3, and 4, the tube 85 is positioned in the enclosure 11 with the panel 87 thereof facing the omega closure members. As previously mentioned, the omega closure means are four substantially rectangular flap-like members 63, 65, 67 and 69 joined along the score line hinge 45 to the omega terminal edge of the respective side members 27, 29, 31 and 33 to provide an overlapping superjacent omega closure arrangement 71.

To add further beneficial protection for the tube 85, substantially resilient supportive means 109 are positioned to cushion substantially the corner areas of the panel portion 87 of the tube relative to the side walls and the omega closure portion of the enclosure 11. This cushioning means may be formed of a substance such as corrugated or cellular plastic or paperboard material that evidences a degree of resilience. The exemplary supportive means shown are four like corner supports formed of plastic foam material known to the art, such being fitted over the panel corners of the tube to provide snug positioning within the enclosure.

The integral enclosure structure 11 of the invention, which is formed from a one-piece unitary sheet of material, supplants a plurality of separate structural pieces, and provides an improved supportive enclosure that exhibits marked structural rigidity and improved protective features for the individual tube accommodated therein. The multiple folds of the one-piece integration provide a beneficial structural integration which manifests enhanced supportive characteristics.

While there has been shown and described what are at present considered the preferred embodiments of the invention, it will be obvious to those skilled in the art that various changes and modifications may be made therein without departing from the scope of the invention as defined by the appended claims.

What is claimed is:

1. An improvement in a single cavity packaging enclosure for supporting and protecting a cathode ray tube comprising:

an integrated packaging structure formed from a unitary sheet of foldable substantially rigid material of substantially elongated shaping having spaced apart alpha and omega fold-score-lines extending longitudinally therein and defining therebetween the central portion of said sheet; three parallel spatially-related fold-score-lines traverse said central portion in a manner normal to said alpha and omega score lines to divide said central portion into first, second, third and fourth integral wall-members and subsequently provide corner formations therefore; extending outward from said alpha score-line related to said first and third wall members are similar integral substantially rectangular extension members wherein each has spaced apart and parallelly related proximal and distal traversal score-lines dividing said extension members into base, side and terminal portions, each of said rectangular extensions having a slot formed therein normal to said alpha score-line in a manner to substantially bisect said base portion and extend partially into said side portion; extending outward from said alpha score-line related to said second and fourth wall members are similar integral substantially configurated alpha closure members wherein each has a structural score-line dividing said member into a rectangular planar portion and a plural-tongue projecting portion, said configurated closure members conjunctively providing a subsequent alpha closure arrangement for said packaging means; extending outward from said omega score-line are separate substantially rectangular flap-like members integral with said respective wall members to collectively provide a subsequent overlapping closure arrangement for said tube packaging means.

2. The improvement in the single cavity packaging enclosure according to claim 1 wherein each of said extension members integral with said first and third wall members has at least one shallow longitudinal cut-defined lip hinged along the respective distal traversal score line and cut slightly into the respective contiguous terminal portion.

3. The improvement in the single cavity packaging enclosure according to claim 1 wherein each of the plural-tongue projecting portions of said respective second and fourth wall related configurated members has a central cut-out segment having a depth less than the depth of said projecting portion, each cut-out segment substantially dividing the respective projecting portion into two substantially equal parts.

4. The improvement in the single cavity packaging enclosure according to claim 3 wherein each of said parts has a cleft formed therein in a manner to extend from the forward edge thereof a partial distance toward said structural score-line, said cleft dividing each of said parts into two tongue-like segments.

5. The improvement in the single cavity packaging enclosure according to claim 1 wherein said substantially rigid material is of corrugated construction wherein the strengthening flutes of said material are oriented in a manner normal to said alpha and omega score lines, and wherein the proximal and distal traversal score-lines of the extension members of said first and third wall members are formed normal to the orientation of said flutes.

6. An improvement in a single cavity packaging means for enclosing, supporting and protecting a cathode ray tube, said means comprising:

an integral enclosure structure in the form of a single protective compartment having definitive members adapted for supporting and encompassing the panel, funnel and neck portions of a cathode ray tube; said enclosure means being formed from a one-piece unitary sheet of substantially rigid material having a number of pre-defined fold-score-lines therein delineating a plurality of related first, second, third and fourth wall members, the boundary edges of said first and fourth wall members being joined to produce a four wall compartment having opposed alpha and omega closure means formed as integral extended portions of said wall members; said first and third wall members having separate foldable extension members integrally projecting from the alpha terminal edges thereof and folded interiorly along spaced apart and parallelly related proximal and distal score-lines in a manner demarcating base, side and terminal portions to provide two opposed wall-oriented structures parallel with said first and third wall members, the terminal portion of each of said structures being folded along a distal score-line toward the respective side member to provide shelf-like supportive means for the funnel portion of said tube, said distal score line having at least one shallow, longitudinal cut-defined lip configuration cut into the edge of said shelf support and hinged along the distal score line to effect locked positional retention of the score-line fold forming said shelf-like support, said funnel supportive shelf being spaced from said omega closure means; said second and fourth wall members each having a like alpha closure member joined along a score-line hinge to the alpha terminal edge of the respective wall member, each alpha closure member having a traverse structural score-line thereacross dividing said member into a rectangular planar portion and a plural tongue projecting portion, said tongue portions being folded inwardly in a manner substantially normal to said planar portions whereupon said tongue portions meet in juxtapositional relationship for insertion into slot means formed in the base portion of said wall-oriented structures to provide an alpha closure arrangement; said juxtapositionally related tongue portions each having a common cutout segment dimensioned to spatially accommodate the neck portion of said tube positioned adjacently therein, said tube being positioned with the panel thereof facing said omega closure members; said omega closure means being four substantially rectangular flap-like members whereof each is joined along a score-line hinge to the omega terminal edge of a respective side member to provide an overlapping superjacent omega closure arrangement; and substantially resilient supportive means positioned to cushion the corner areas of the panel portion of said tube relative to said side walls and the omega closure portion of said enclosure to provide an improved packaging means for a single cathode ray tube.

7. The improvement in the single cavity packaging means according to claim 6 wherein the distal score-lines forming the folded edge portion of each of said tube supporting shelves has two spaced apart cut-out lip configurations spaced in a manner that the weight of the tube supported therealong effects a slight deformation of each lip to further accentuate the locked positional retention of the score-line fold forming said shelf-like support.

8. The improvement in the single cavity packaging means according to claim 6 wherein said substantially rigid material is of corrugated construction wherein the strengthening flutes of said material are oriented normal to said alpha and omega score lines.

* * * * *